United States Patent [19]

Naylor

[11] 4,030,246

[45] June 21, 1977

[54] SLIDING BARN DOOR

[76] Inventor: Donald B. Naylor, Rte. 4, Box 357, Plymouth, Ind. 46563

[22] Filed: July 30, 1975

[21] Appl. No.: 600,713

[52] U.S. Cl. ..... 49/501; 52/625; 52/629

[51] Int. Cl.[2] ..... E06B 3/12

[58] Field of Search ..... 49/501, 409, 426; 52/625, 627, 629

[56] References Cited

UNITED STATES PATENTS

| | | | |
|---|---|---|---|
| 1,560,526 | 11/1925 | Barrows | 49/426 |
| 1,887,819 | 11/1932 | Nelson | 49/426 |
| 3,242,535 | 3/1966 | Ferris | 49/409 |
| 3,479,770 | 11/1969 | Mock | 52/627 X |

*Primary Examiner*—Kenneth Downey
*Attorney, Agent, or Firm*—Oltsch & Knoblock

[57] ABSTRACT

A barn door which includes a pair of vertical side frame members and horizontal top and bottom frame members joined at their respective end portions to define a four-sided opening between the frame members. A girt is supported by and extends between the side frame members. Siding is applied over one side of the girt to cover the opening between the frame members.

5 Claims, 8 Drawing Figures

22
54
26
14
16
32
42
30
46
44
28
24
54
20
5.
40
45
5.
36
56
36
49
48
34
32
46
50
20
45
36
22
7.
24
38
7.
36
36
49
50
8.
28
40
44
6.
8.
26
30
42
18
14
6.

22
62
16
24
14
20
54
54
30
28
46
36
36
40
46
56
26
44
42
42
44
24
38
45
20
36
45
36
28
46
40
48
14
30
26
18

SLIDING BARN DOOR

SUMMARY OF THE INVENTION

This invention relates to a door construction and will have specific, but not limited, application to a sliding barn door.

The barn door of this invention includes two vertical side frame members and two horizontal top and bottom frame members which are joined at their respective end portions to form a four-sided opening between the frame members. At least one girt is supported by and extends between the side frame members. Siding is applied over one side of the girt and covers the opening between the frame members. A track and wheel or similar type sliding arrangement is provided for the purpose of securing the door to a barn support for opening and closing sliding movement.

Accordingly, it is an object of this invention to provide a sliding barn door which is of a strong, durable construction.

Another object of this invention is to provide a door which is for a barn and which is of a pleasing appearance.

Still another object of this invention is to provide a door which is of high strength and economical construction.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It has been chosen and described in order to best explain the principles of the invention and its application and practical use to thereby enable others skilled in the art to best utilize the invention.

Figure 1:
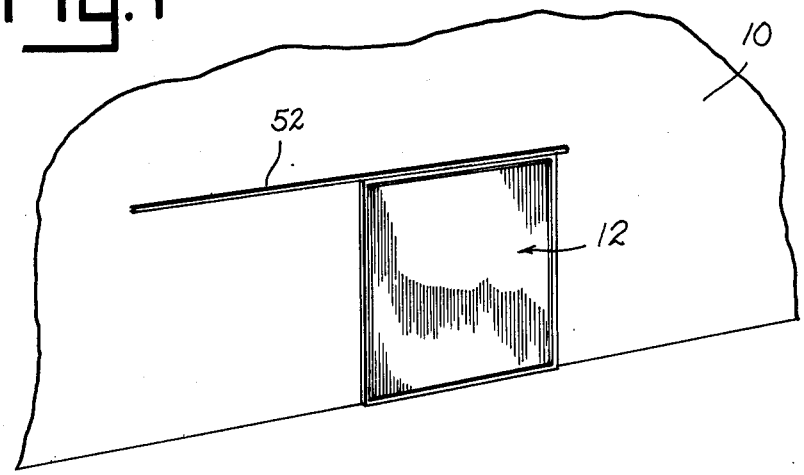
FIG. 1 is a perspective view of a fragmentary barn side which includes the door of this invention.
Figure 2:
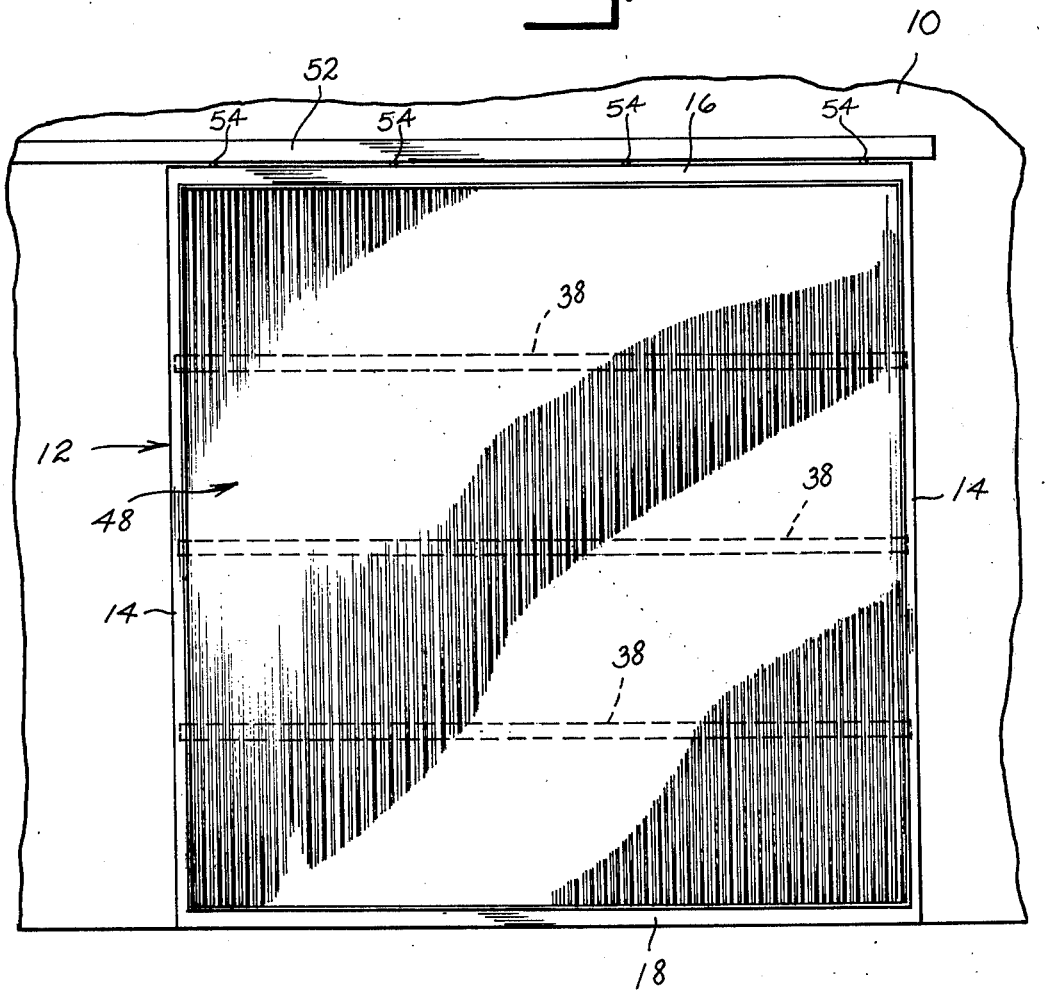
FIG. 2 is a larger front elevational view of the door shown in FIG. 1.
Figure 3:
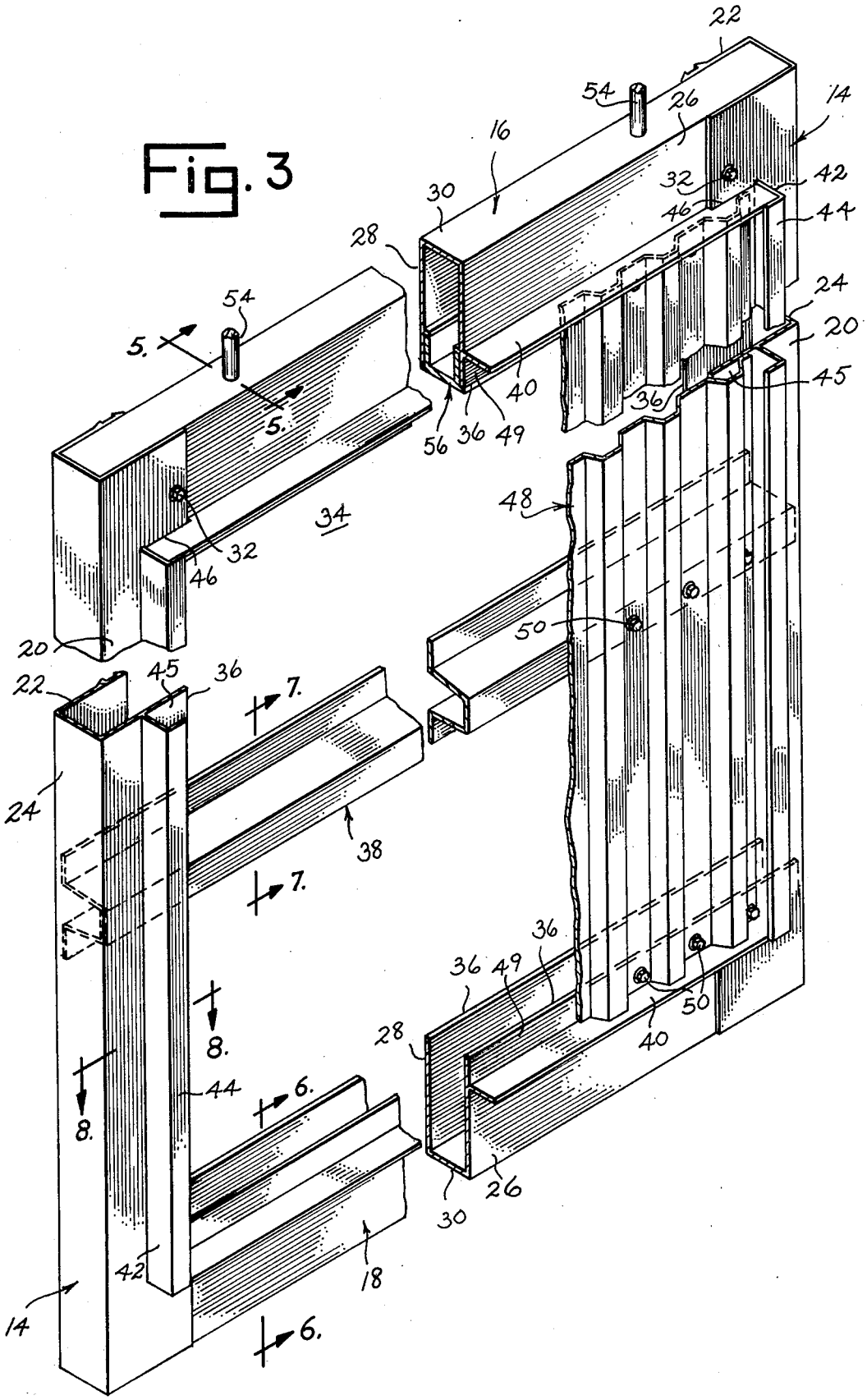
FIG. 3 is a fragmentary view showing the component parts of the door.
Figure 4:
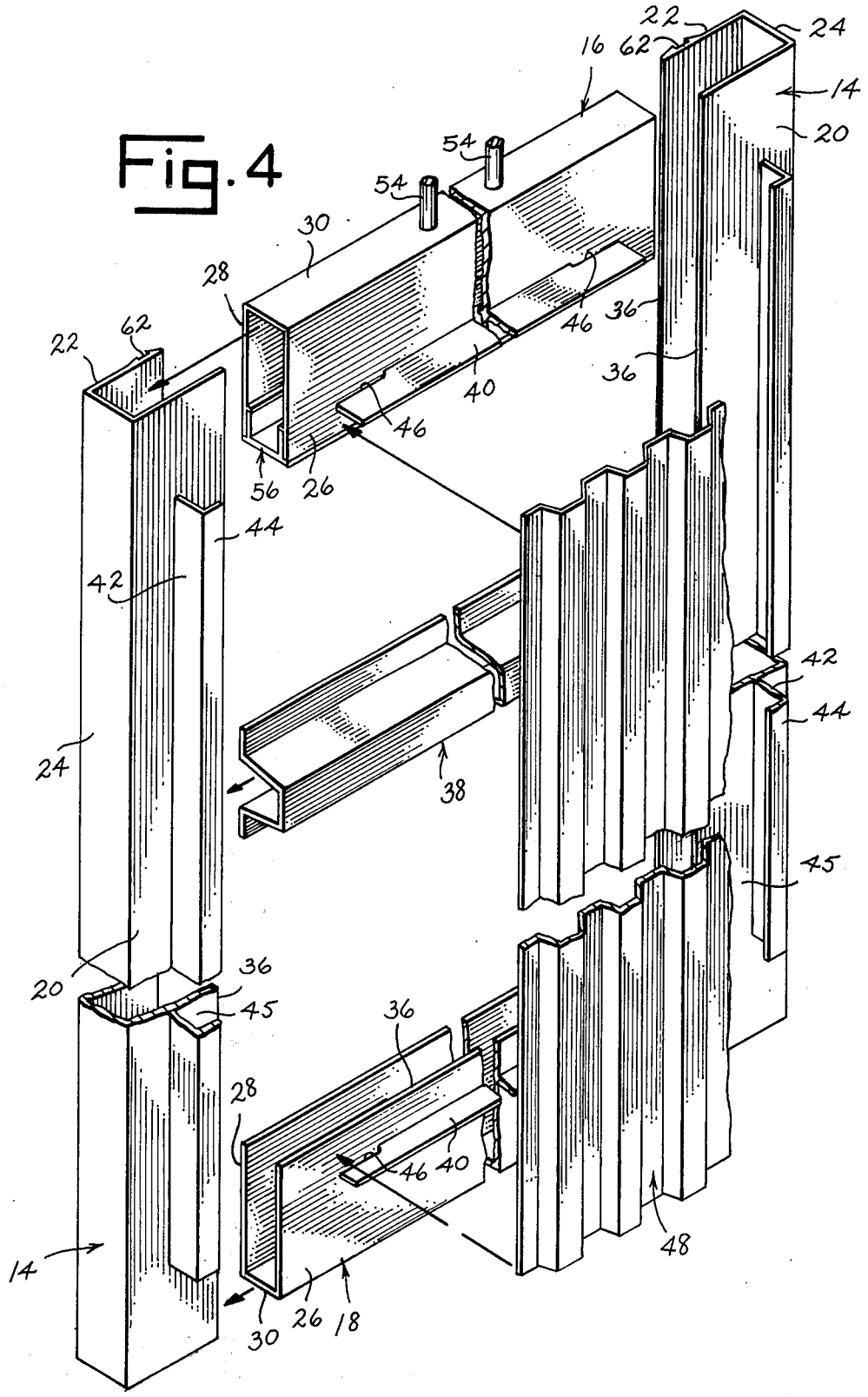
FIG. 4 is a fragmentary view of the barn door showing the parts thereof in exploded form.
Figure 5:
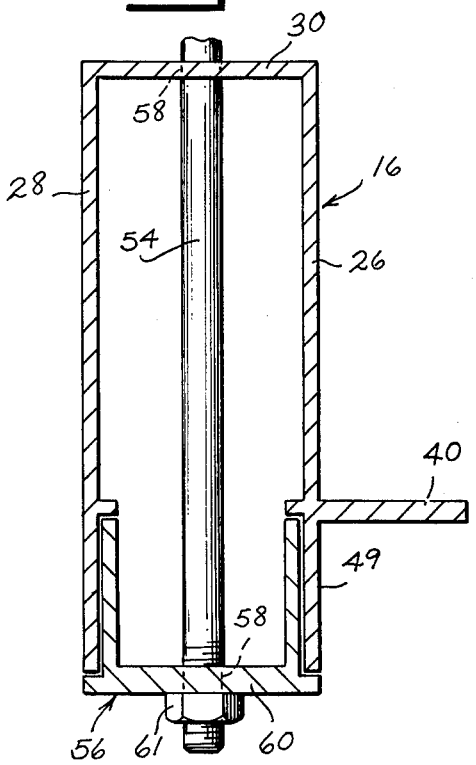
FIG. 5 is a sectional view taken along line 5—5 of FIG. 3.
Figure 7:
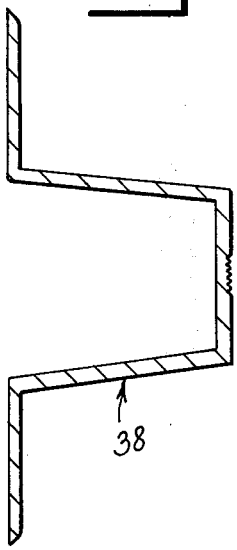
FIG. 7 is a sectional view taken along line 7—7 of FIG. 3.
Figure 6:
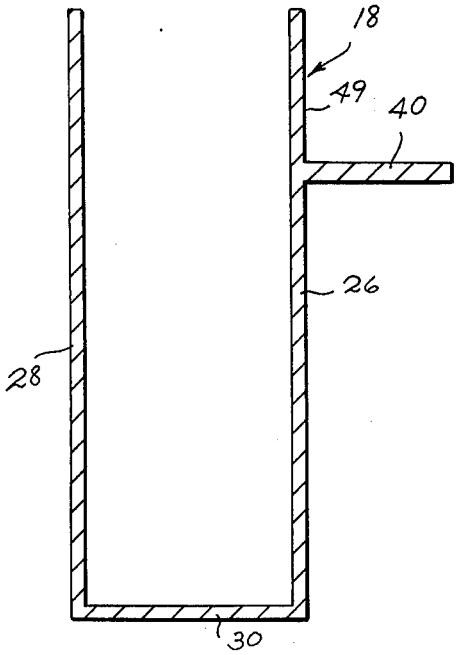
FIG. 6 is a sectional view taken along line 6—6 of FIG. 3.
Figure 8:
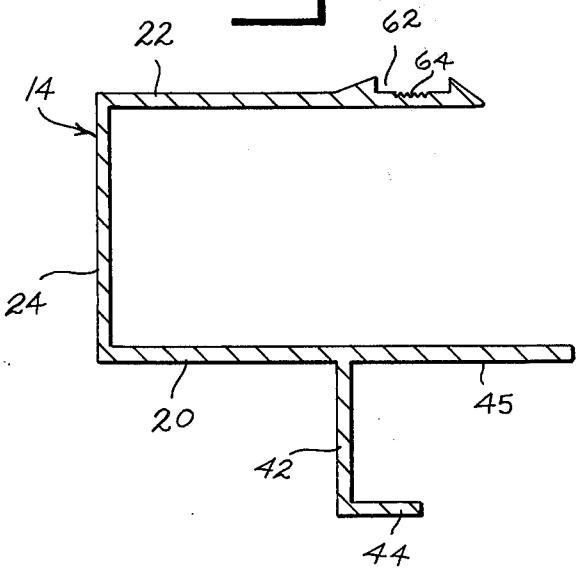
FIG. 8 is a sectional view taken along line 8—8 of FIG. 3.

In FIGS. 1 and 2, side 10 of the barn is shown. Mounted to barn side 10 is door 12. Door 12 includes vertical side frame members 14 interconnected by a horizontal top frame member 16 and a horizontal bottom frame member 18. Each side frame member 14 is of a U-shaped cross sectional configuration having an outer side 20 and an inner side 22 interconnected by a web part 24. Each top and bottom frame member 16 and 18 is also of a U-shaped cross sectional configuration having an outer side 26, an inner side 28 and a connecting web part 30. Each top and bottom frame member 16 and 18 has its end portions inserted into side frame members 14 between sides 20 and 22 of the side frame members and in general abutment with web part 24 of the members. Screws 32, similar attachment means or even welds can be utilized to secure side frame members 14 and top and bottom frame members 16 and 18 together. Connected frame members 14, 16 and 18 form a frame having a four-sided opening 34 defined by respective inner edges 36 of the frame members. A plurality of girts 38 paralleling top and bottom frame members 16 and 18 extend between and are supported by side frame members 14. Girts 38, which may be of a flanged channel-shape in cross section, as illustrated in the drawings, or which may be tubular depending upon the strength requirements of the door, are preferably spaced apart an equal distance from each other and the same distance from top and bottom frame members 16 and 18. The number of girts 38 utilized for each door will depend upon the desired size of the door. The end portions of each girt 38 extend into side frame members 14 between the outer and inner sides 20 and 22 of the frame members and are secured to the frame members by means of screws, similar fastening means or welds.

Top and bottom frame members 16 and 18 include a flange 40 which projects outwardly at a general right angle from the outer side 26 of each such frame member, paralleling but spaced from the inner edge 36 of the frame member. Each side frame member 14 includes a flange 42 which projects outwardly at a general right angle from outer side 20 of the frame member and which parallels and is spaced from inner edge 36 of the frame member. Each flange 42 of frame members 14 terminates in a lip 44 which is directed toward the inner edge 36 of the frame member and which overlies that marginal portion 45 of the frame members extending between flange 42 and inner edge 36. Flange 40 of top and bottom frame members 16 and 18 are cut away at 46 so as to receive inner edges 36 of outer sides 20 of the side frame members during assembly.

Siding 48 is applied over girts 38 and covers opening 34 formed by frame members 14, 16 and 18. Siding 48 extends from one flange 40 to the other flange 40 of top and bottom members 16 and 18 and from one flange 42 to the other flange 42 of side frame members 14, overlying marginal portions 45 of frame members 14 and the marginal portions 49 of frame members 16 and 18. Siding 48 is preferably of a corrugated type, such as that shown in the drawings, but may also be of a flat sheet-like configuration. Screws 50, similar fastening means or welds may be utilized to secure siding 48 to frame members 14, 16 and 18 and girts 38.

Door 12 is supported for sliding movement in an elongated rail or track 52. A plurality of wheels (not shown) carried by track 52 support a series of hangers 54 which in turn are connected to top frame member 16 of the door. Track 52, the wheels and hangers 54 are of a standard construction utilized for many years in sliding barn doors. A U-shaped channel part 56 is fitted upwardly into the bottom opening of top frame member 16 and may be secured to the top frame member by fastening means such as screws or by welds. Hangers 54 extend through aligned openings 58 in the web part 30 of the top frame member and in the bottom web 60 of channel part 56. A nut 61 is screwed onto the threaded end of each hanger 54 and is brought to bear against bottom web 60 of channel part 56 when the door is suspended from track 52.

Frame members 14, 16 and 18 of door 12 may be provided with flat-bottomed grooves 62 into which are formed a plurality of longitudinally extending, parellel serrations or teeth 64. Teeth 64 in grooves 62 form an anchoring means by which self-tapping screws can be turned and driven into the sides of the frame members during assembly of door 12.

It is to be understood that the invention is not to be limited to the details above given but may be modified within the scope of the appended claims.

What I claim is:

1. A barn door comprising a pair of vertical side frame members, a horizontal top frame member and a horizontal bottom frame member, said frame members being joined at their respective end portions to define a four-sided opening between the frame members, a girt supported by and extending between said side frame members, siding applied over one side of said girt and covering said opening between the frame members, and means associated with said top frame member for securing said door to a barn support for opening and closing movement of the door, each frame member including a side located within the same general plane as said one girt side and defined by an outer edge which forms a part of the outside perimeter of the door and an inside edge which forms a part of the perimeter of said opening between the frame members, each frame member including a flange projecting outwardly from its said side and spacedly parelleling its said inside edge, said flanges forming a four-sided frame part about said opening, said siding fitted within said frame part and overlapping said frame members where said flanges are spaced from the inside edges of the frame members, each side frame member having a U-shaped cross sectional configuration including its said side and a spaced second side interconnected at the outer edge of the frame member by a web, the end portions of said top and bottom frame members fitting into said side frame members between the spaced sides of the side frame members.

2. The barn door of claim 1 wherein said girt includes opposite end portions each fitted between the sides of a side frame member.

3. The barn door of claim 2 and a plurality of girts extending between said side frame members, said girts paralleling said top and bottom frame member and being spaced apart, each girt including end portions fitted between the sides of said side frame members.

4. The barn door of claim 1 wherein one of said sides of each side frame member has a plurality of parallel longitudinally directed serration means formed in it, self-tapping screws turned first through said side frame member sides at said serration means and into a said top and bottom frame member and girt to secure said top and bottom frame member and girt to said side frame members, said serration means for locating said screws during insertion of the screws into said frame members and girt.

5. The barn door of claim 1 wherein the flange of each side frame member terminates in an in-bent lip directed toward said four-sided opening and overlying said siding.

* * * * *